US008157576B2

(12) United States Patent
Fu et al.

(10) Patent No.: US 8,157,576 B2
(45) Date of Patent: Apr. 17, 2012

(54) CARD EDGE CONNECTOR WITH AN IMPROVED LATCH MECHANISM

(75) Inventors: Xiao-Zhi Fu, Kunshan (CN); Wen-Jun Tang, Kunshan (CN); Zhuang-Xing Li, Kunshan (CN); Xue-Wu Bu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/909,836

(22) Filed: Oct. 22, 2010

(65) Prior Publication Data

US 2011/0097913 A1 Apr. 28, 2011

(30) Foreign Application Priority Data

Oct. 22, 2009 (CN) ..... 200920313018.1

(51) Int. Cl.
*H01R 13/62* (2006.01)

(52) U.S. Cl. ..... 439/153; 439/327

(58) Field of Classification Search ..... 439/153, 439/157, 325–329, 260, 377
See application file for complete search history.

(56) References Cited

U.S. PATENT DOCUMENTS

| | | | | |
|---|---|---|---|---|
| 6,250,938 | B1 * | 6/2001 | Tung | 439/160 |
| 7,244,134 | B2 | 7/2007 | Ju | |
| 8,007,303 | B2 * | 8/2011 | Yao et al. | 439/327 |
| 2009/0104793 | A1 | 4/2009 | Chung et al. | |

* cited by examiner

*Primary Examiner* — Khiem Nguyen
(74) *Attorney, Agent, or Firm* — Weit Te Chung; Andrew C. Cheng; Ming Chieh Chang

(57) ABSTRACT

A card edge connector for use with an electronic card, comprises an elongated housing having a pair of opposed side walls along a lengthwise direction, a central slot between the side walls, a tower portion upwardly extending at one end thereof. The central slot extends into the tower portion along the lengthwise direction to define a trench for receiving a side edge of the electronic card. A latch mechanism is retained in the tower portion, and has a locking projection protruding into the trench to lock with the electronic card.

11 Claims, 6 Drawing Sheets

CARD EDGE CONNECTOR WITH AN IMPROVED LATCH MECHANISM

BACKGROUND OF THE INVENTION

1. Field of the Invention

The present invention relates to a card edge connector, more particularly to a card edge connector with an improved latch mechanism.

2. Description of Related Art

Card edge connectors are employed widely in computers to receive a memory card, graphic card, network interface et al. The card edge connector usually has an elongated housing, a plurality of contacts retained in the housing for electrically connecting a corresponding mating card, and at least one latch mechanism at one end of the housing and capable of rotating around the housing. The housing has a pair of side walls, a central slot between the side walls for receiving the mating card, and a tower portion at one end thereof. The tower portion defines a pair of pivot holes recessed on two opposite outer side surfaces, and a pair of locating slots extending upwardly therethrough from the pivot holes, respectively. The latch mechanism is a bent metallic rod, and includes an upper horizontal rod above the tower portion, two vertical rods extending downwardly from two opposite side ends of the horizontal rod and corresponding to the locating slots, and a pair of lower shafts extending inwardly from the vertical rods respectively. One vertical rod is longer than the other vertical rod to define an operating portion protruding outwardly therefrom for use with an operator. The shafts are pivoted in the pivot holes of the housing respectively.

Before the mating card is inserted in the central slot of housing, the latch mechanism is pivoted outwardly by operator pushing the operating portion to urge vertical horizontal rods to move to an outer side and the vertical rods withdrew from the locating slots respectively. After the mating card has been inserted into the central slot. The latch mechanism is pivoted inwardly by the operator pulling the operating portion back to urge the horizontal rod to move and press on an upper edge of the mating card for locking the mating card. The vertical rods are retained in the locating slots respectively for stopping the latch mechanism from rotating. The latch mechanism will be pivoted outwardly again while the mating card is requested to withdraw from the housing. Thus, It is complexly to insert and withdraw the mating card for the operator.

Hence, an improved card edge connector is desired to overcome the above problems.

BRIEF SUMMARY OF THE INVENTION

According to one aspect of the present invention, a card edge connector for insertion of an electronic card with a first side edge defining at least one notch, comprising: an elongated housing having a pair of opposed side walls extending along a lengthwise direction thereof, a central slot located between the side walls for receiving a lower edge of the electronic card, a first tower portion upwardly extending from one end thereof, the central slot extending into the first tower portion along the lengthwise direction to define a trench for receiving the first side edge of the electronic card; a plurality of contacts retained in the housing, and exposed into the central slot for mating with the electronic card; and a latch mechanism retained in the first tower portion, and having a locking projection protruding into the trench to lock with the electronic card; wherein the latch mechanism is a bent rod, and can be posited at a first position when the locking projection is in the trench or alternatively at a second position when the locking projection is deformed away from the trench; wherein during inserting the electronic card into the central slot, the first side edge of the electronic card presses the locking projection to the second position, and when the electronic card is inserted in the central slot completely, the locking projection correspondingly buckles the notch of the first side edge of the electronic card so that the locking projection returns to the first position.

According to another aspect of the present invention, a card edge connector comprising: an elongated housing extending along a lengthwise direction, and defining a center slot extending in the housing along the lengthwise direction, and a pair of tower portions located at two opposite ends thereof; a plurality of contacts disposed in the housing and located at two sides of the center slot; a push-out ejector rotatably mounted in one of the tower portions and defining a locking head extending into the central slot; and a resilient latch mechanism fixed to the other one of the tower portions and defining a pair of locating portions retained in the housing, and a pair of inclined portions extending slantly downwardly toward each other to intersect with each other to defines a lower locking projection extending into the center slot, the inclined portions each connecting with the locating portion to define a pivot therebetween, the inclined portions being flexibly deformed and pivot around the pivots to urge the locking projection to move along the lengthwise direction during one side edge resisting the inclined portions; wherein the locking head of the ejector and the locking protrusion are located two different high for respectively locking into corresponding notches respectively located on two sides of an electronic card at the two different high.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
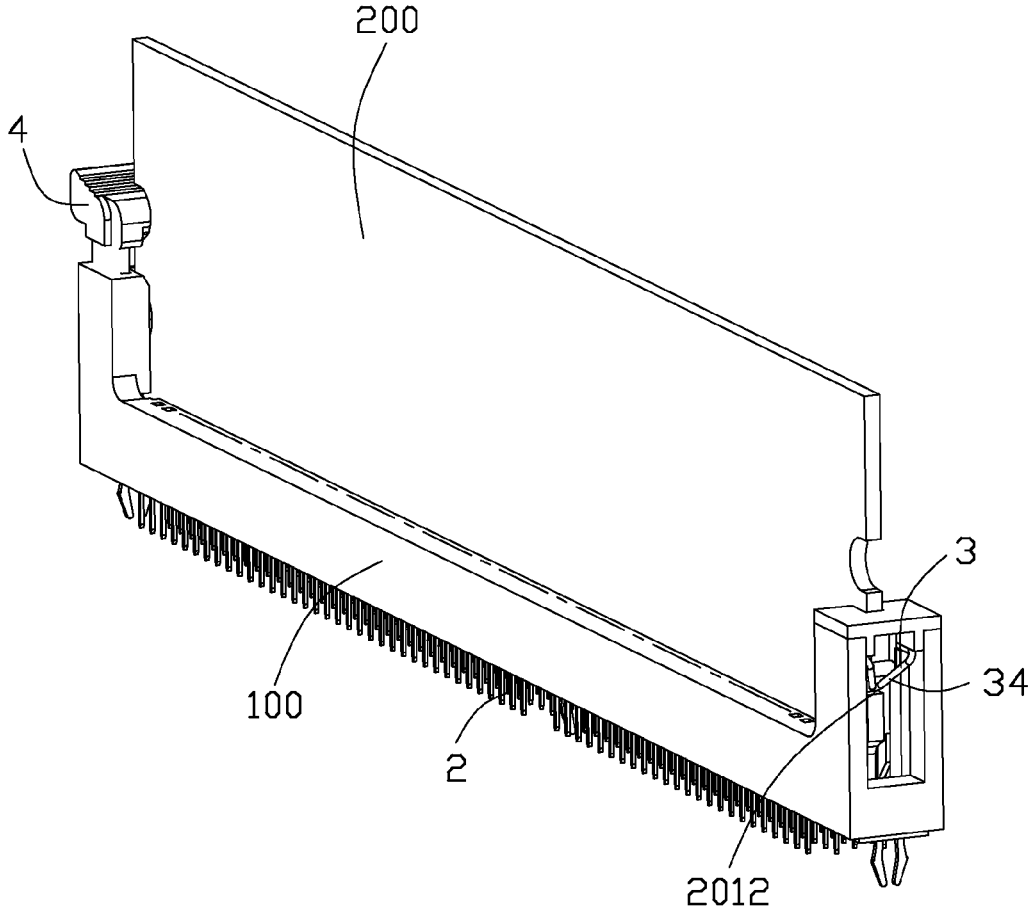
FIG. 1 is a perspective view of a card edge connector according to a preferred embodiment of the present invention with an electronic card inserted thereinto.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
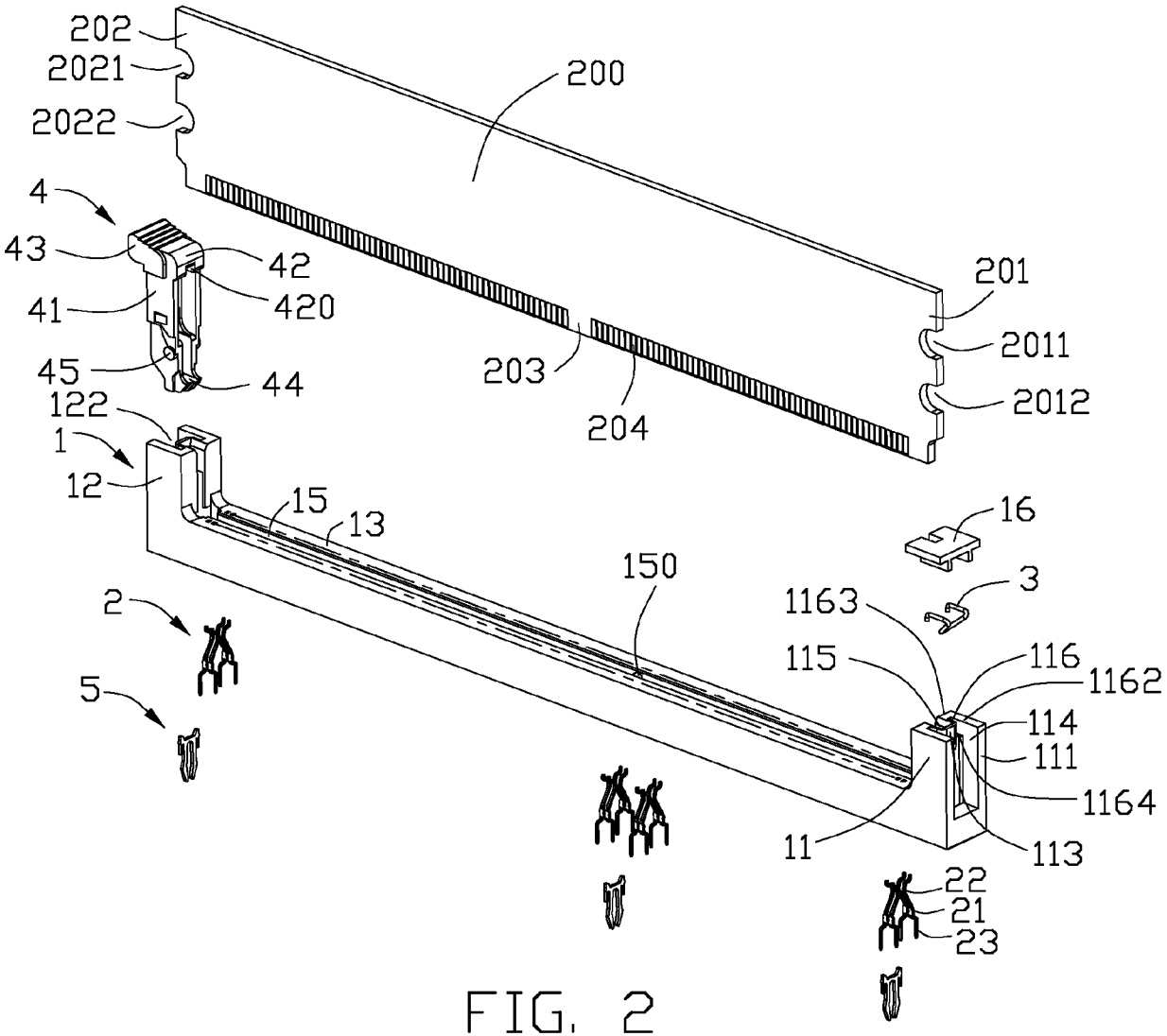
FIG. 2 is an exploded view of the card edge connector and the electronic card shown in FIG. 1.
Figure 3:
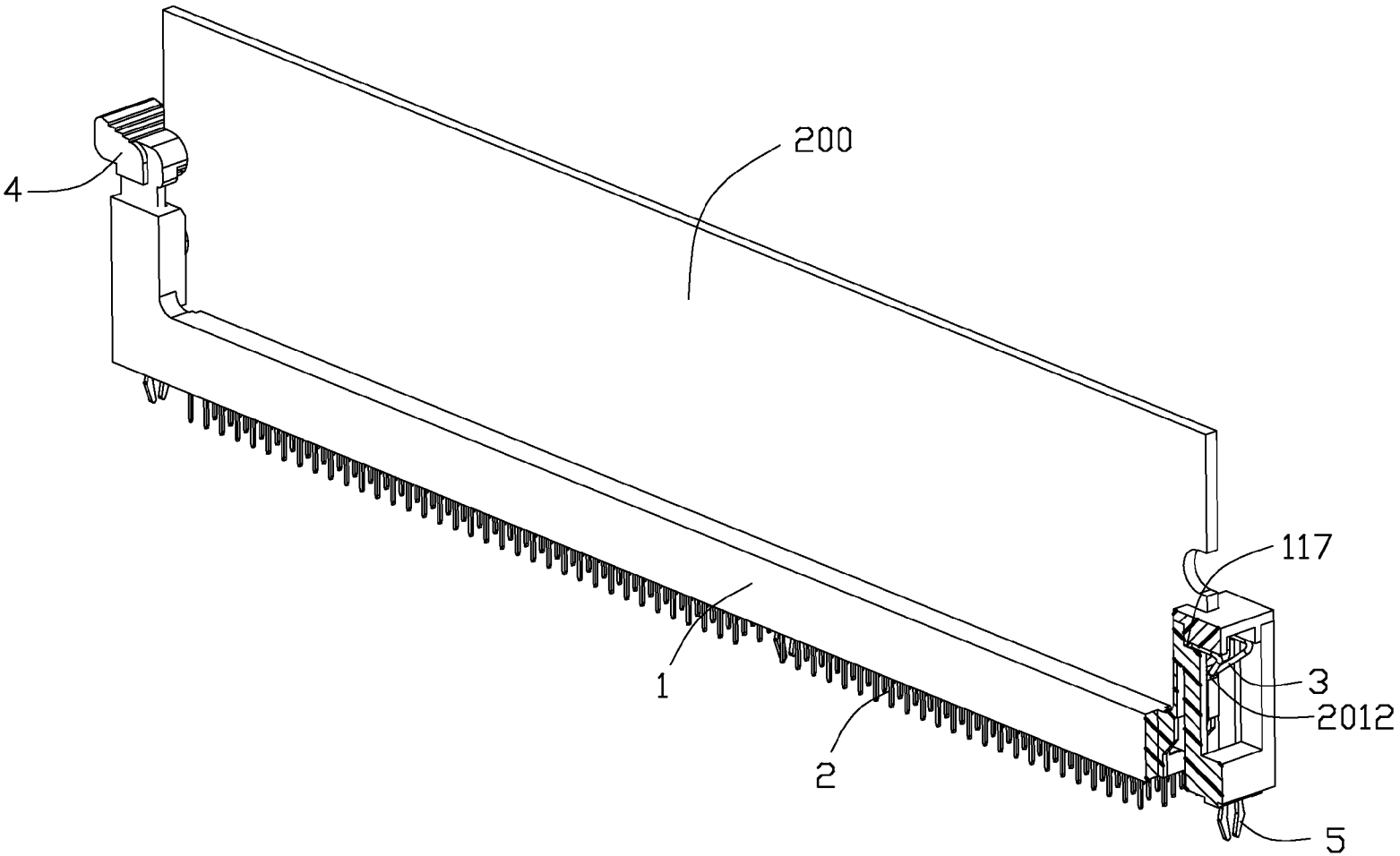
FIG. 3 is a partially cross-sectional view of the card edge connector shown in FIG. 1.
Figure 4:
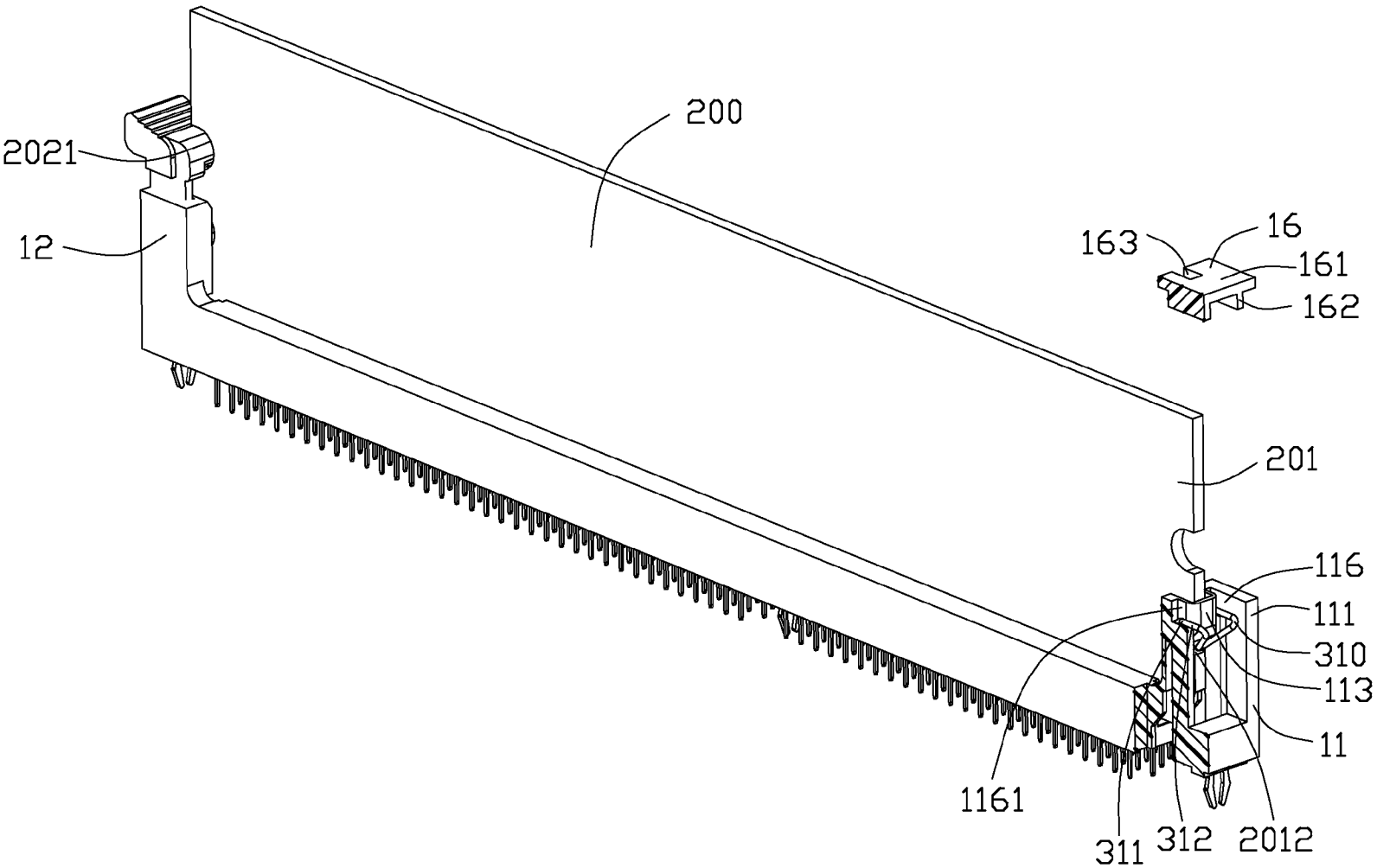
FIG. 4 is a partially exploded view of the card edge connector shown in FIG. 3.
Figure 5:
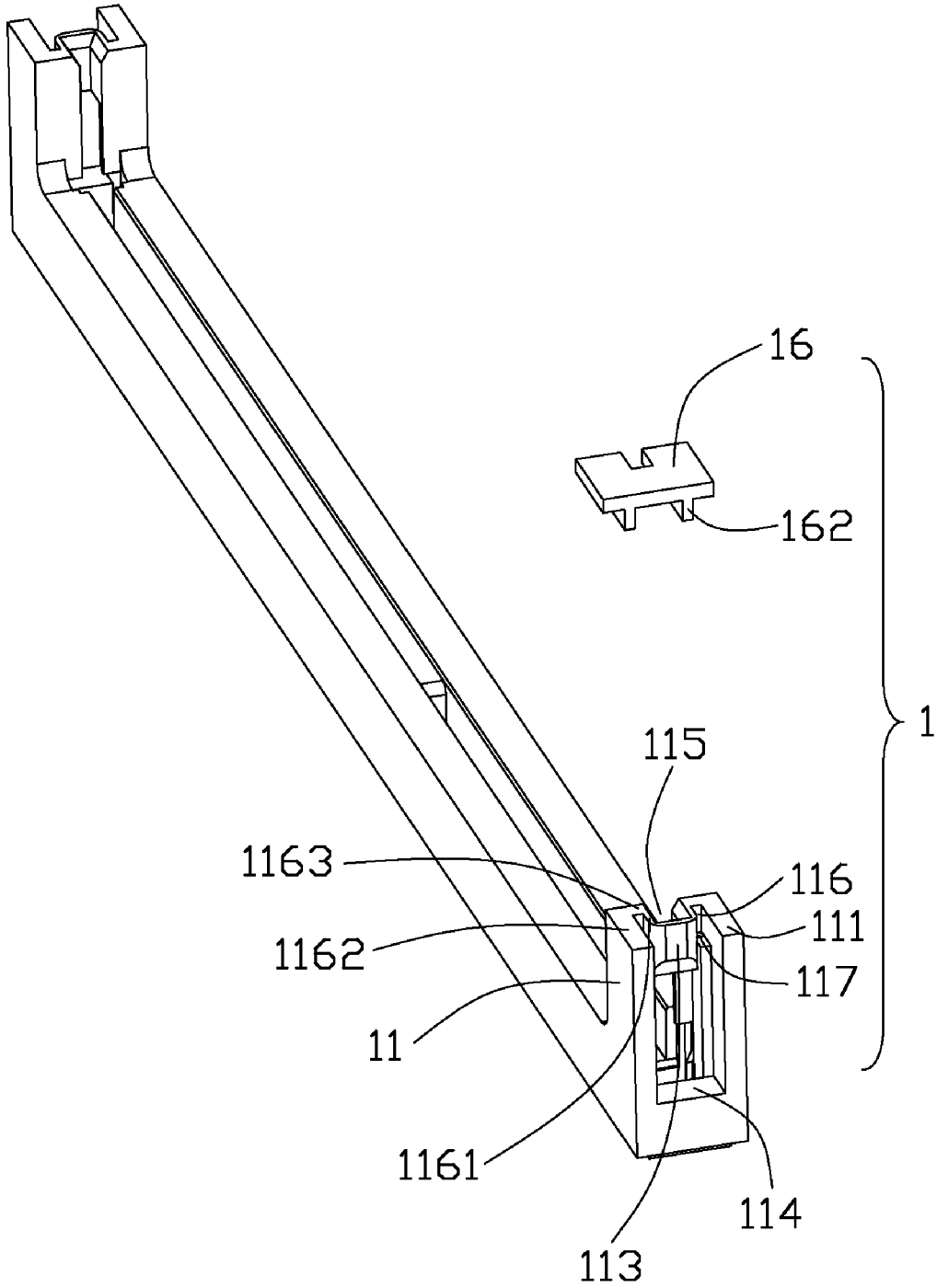
FIG. 5 is an exploded view of an elongated housing of the card edge connector shown in FIG. 4.
Figure 6:
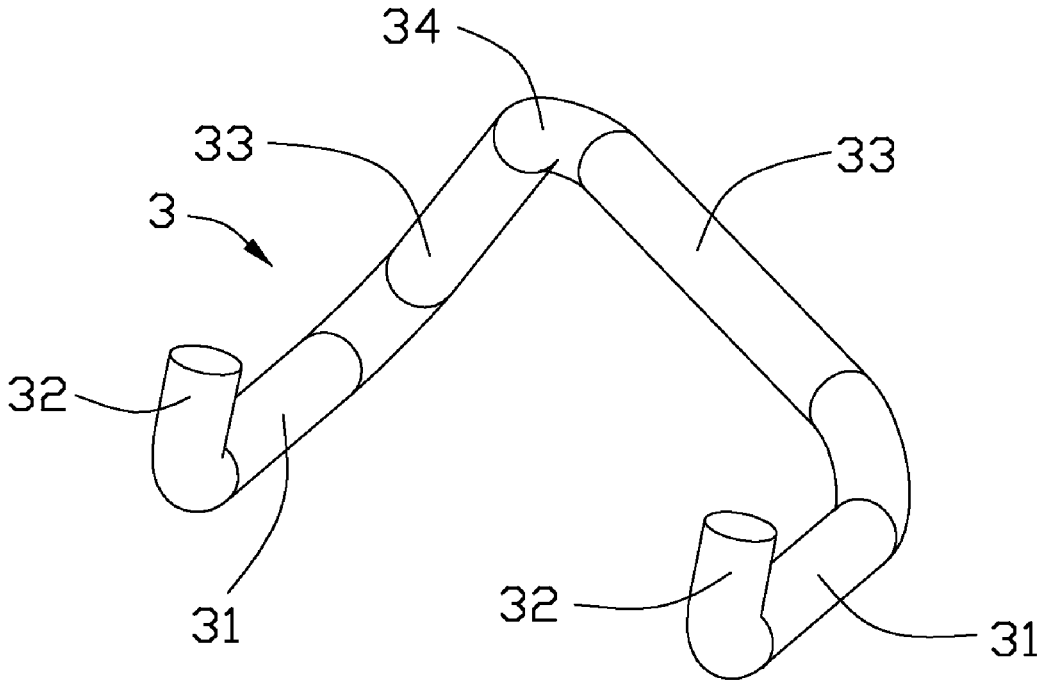
FIG. 6 is a perspective view of a latch mechanism of the card edge connector shown in FIG. 1.

Referring to FIGS. 1-6, a card edge connector 100 is for use with an electronic card 200 according to a preferred embodiment of the present invention is disclosed. The card edge connector 100 comprises an elongated housing 1, a plurality of contacts 2 retained in the housing 1, a latch mechanism 3 and a push-out ejector 4 attached to opposite two ends of the housing 1 for locking with the electronic card 200, and a number of metal board locks 5 retained at a bottom portion of the housing 1 to fasten with a mother board (not shown).

The electronic card 200 is a standard DDR3 module, and has a lower edge 203 with a plurality of metal fingers 204 formed thereon to electrically connect with the contacts 2, and two opposite first and second side edges 201, 202 at two side thereof. The first and the second side edges 201, 202 each defines an upper notch 2011, 2021, and a lower notch 2012, 2022 spaced away from the upper notches 2011, 2021 respectively.

The housing 1 has two opposite side walls 13 extending along a lengthwise direction thereof, a central slot 15 formed therebetween, a first tower portion 11 and a second tower portion 12 respectively extending upwardly from opposite two ends of the side walls 13, and an insulative cover 16 retained on a top portion of the first tower portion 11. The central slot 15 is adapted for receiving the lower edge 203 of the electronic card 200. The side walls 13 each defines a plurality of passageways (not shown) in communication with the central slot 15 for retaining the contacts 2. The housing 1 is formed with a key portion 150 to divide the central slot 15 into two parts with different length for preventing the electronic card 200 from mis-mating.

The first tower portion 11 defines a pair of retention walls 111 opposited to each other in a transverse direction perpendicular to the lengthwise direction, a trench 115 and a cavity 114 both disposed between the pair of retention walls 111 in the transverse direction, and a reinforcement wall 113 connected between the pair of retention walls 111. The trench 115 is communicated with an end part of the central slot 15 for receiving the first side edge 201 of the electronic card 200 to limit the electronic card 200 from moving along the transverse direction. The cavity 114 passes through a lower portion of the reinforcement wall 113 to communicate with the trench 115 along the lengthwise direction.

The retention walls 111 each defines a retention slot 116 recessed downwardly from an upper surface thereof and located an outside of the reinforcement wall 113 for retaining the cover 16. The retention slots 116 communicate with the cavity 114 respectively. The retention slots 116 each has a first wall 1161, a second wall 1162 opposited to the first wall 1161 in the transverse direction, an end wall 1163 connected therebetween to present as U-shaped viewed along a top side, and a lower wall 1164 enclosing a lower portion thereof. The first walls 1161 are located between the second walls 1162 along the transverse direction. The reinforcement wall 113 is connected between the first walls 1161 to define the trench 115 thereamong. The lower walls 1164 each is connected among the first walls 1162 and the end wall 1163, and defines a retention hole 117 recessed downwardly. The retention hole 117 is adjacent to the end wall 1163 and in communication with the retention slot 116.

The cover 16 includes a top plate 161 covering the top surface of the first tower portion 11, a pair of protrusions 162 corresponding to the retention slots 116, and a cutout 163 recessed on a side edge and aligned with the trench 115 along an upper-to-lower direction perpendicular to the lengthwise direction and the transverse direction.

The second tower section 12 defines a receiving space 122 for receiving the ejector 4 therein, and a pair of pivot holes (not shown) recessed on two opposite inner walls of the receiving space 122. The receiving space 122 is in communication with the central slot 15.

The contacts 2 are arranged in two rows and each includes a retention portion 21 received in the passageway of the side walls 13, a contact portion 22 extending from an upper portion of the retention portion 21 and exposed into the central slot 15 to electrically connect with the metal fingers 204 of the electronic card 200, and a tail portion 23 extending beyond the housing 1 from a lower portion of the retention portion 21 to connect with the mother board.

The latch mechanism 3 is a metallic rod or an insulative rod, and includes a pair of horizontal portions 31 opposited to each other along the transverse direction and extending along the lengthwise direction, a pair of retaining portions 32 each bending and extending downwardly from ends of the horizontal portions 31, and a pair of inclined portions 33 extending downwardly from the other ends of the horizontal rods 31. The trench 115 is located between the pair of horizontal portions 31 along the transverse direction. The pair of inclined portions 33 further extend toward each other to be connected with each other, and define a V-shaped locking projection 34 therebetween. The inclined portions 33 each connects with the horizontal portion 31 to define a pivot 310 therebetween. The inclined portions 33 can flexibly deform and pivot around the pivots 310 to urge the locking projection 34 to move along the lengthwise direction.

The latch mechanism 3 is retained downwardly in the first tower portion 11. The horizontal portions 31 each has an inner part 311 received in the retention slot 116, and an outer part 312 extending beyond the retention slot 116 into the cavity 114 from the inner part 311. The inner part 311 of the horizontal portions 31 each is sandwiched between the lower wall 1164 and the protrusion 162 of the cover 16 for being prevented from moving along the upper-to-lower direction. The inclined portions 33 are disposed in the cavity 114. The locking projection 34 is disposed in the trench 115 for locking the electric card 200.

The ejector 4 is rotatably retained in the second tower portion 12 and has a body portion 41 retained in the receiving space 122, a locking head 42 extending toward the central slot 15 of the housing 1 from a top end of the body portion 41, an operating portion 43 outwardly extending from the top end of the body portion 41, and an ejecting portion 44 inwardly extending from a lower end of the body portion 40 to be under the central slot 15 for ejecting the electronic card 200 out of the central slot 15. The body portion 41 is formed with a pair of shafts 45 outwardly extending from two sides thereof to engage with the pivot holes of the second tower portion 12. The locking head 42 defines a depression 420 recessed upwardly from a lower surface thereof for retaining the second side edge 202 of the electronic card 200 therein. The operating portion 43 extends beyond the second tower portion 12 for being operated conveniently. The ejecting portion 44 extends to a lower side of the receiving space 122 to resist the lower edge 203 of the electronic card 200.

In the insertion process of the electronic card 200, firstly, rotating the ejector 4 outwardly to urge the locking head 42 to moving outwardly respect to the housing 1; then inserting the electronic card 200 downwardly, the first side edge 201 of electronic card 200 enters into the trench 115, and resists the inclined portions 33 to urge the locking projection 34 to moving out of the trench 115 into the cavity 114, secondly, further inserting the electronic card 200 downwardly, the lower edge 201 of the electronic card 200 downwardly pushes the ejecting portion 44 to make the ejector 4 rotate along an anticlockwise direction; when the electronic card 200 is completely inserted into the central slot 15, the locking projection 34 returns into the trench 115, and locks with the lower notch 2012 of the first side edge 201, the locking head 42 locks with the lower notch 2022 of the second side edge 2021 of the electronic card 200. The second side edge 202 is sandwiched between two opposite inner walls of the depression 41 for being prevented from moving along the transverse direction.

In a withdrawing process of the electronic card 200, firstly, pressing the operating portion 43 to urge the ejector 4 to rotate along a clockwise direction, then the locking head 42 moves out of the lower notch 2022 of the second side edge 202, and the ejecting portion 44 pushes one side of the lower edge 203 of the electronic card 200 upwardly to make one side of the lower edge 203 out of the central slot 101; then pulling the electronic card 200 upwardly and sidewardly to make the lower notch 2012 of the first side edge 201 disengage from the locking projection 34. Then the electronic card 200 can be dropped out of card edge connector 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector for insertion of an electronic card with a first side edge defining at least one notch, comprising: an elongated housing having a pair of opposed side walls extending along a lengthwise direction thereof, a central slot located between the side walls for receiving a lower edge of the electronic card, a first tower portion upwardly extending from one end thereof, the central slot extending into the first tower portion along the lengthwise direction to define a trench for receiving the first side edge of the electronic card; a plurality of contacts retained in the housing, and exposed into the central slot for mating with the electronic card; and a latch mechanism retained in the first tower portion, and having a locking projection protruding into the trench to lock with the electronic card; wherein the latch mechanism is a bent rod, and can be posited at a first position when the locking projection is in the trench or alternatively at a second position when the locking projection is deformed away from the trench; wherein during inserting the electronic card into the central slot, the first side edge of the electronic card presses the locking projection to the second position, and when the electronic card is inserted in the central slot completely, the locking projection correspondingly buckles the notch of the first side edge of the electronic card so that the locking projection returns to the first position, wherein the latch mechanism is made of metallic material, and includes a pair of inclined portions above the locking projection, during the electronic card inserting into the slot, the first side edge presses the incline portions, wherein the locking projection presents as a V-shaped viewed from a top side, the pair of inclined portions extending slantly and downwardly toward each other, then intersecting with each other to form the locking projection therebetween.

2. The card edge connector as claimed in claim 1, wherein the housing includes a cover retained on a top portion of the first tower portion, the latch mechanism is wholly retained in the first tower portion and sandwiched between the cover and the tower portion.

3. The card edge connector as claimed in claim 2, wherein the first tower portion includes a pair of retention walls located at two opposite sides of the trench, a reinforcement wall connected between the pair of the retention walls, and a cavity passing through a lower portion of the reinforcement wall to communicate with the trench along the lengthwise direction, the latch mechanism is retained on the pair of retention wall, the locking projection enters into the cavity at the second position.

4. The card edge connector as claimed in claim 3, wherein the pair of retention walls each defines a retention slot recessed downwardly from an upper surface thereof, the retention slots each defines a lower wall, the cover has a top plate covers the upper surfaces of the retention walls, and a pair of protrusions protruding downwardly into the retention slots from the top plate respectively, the top plate defines a cutout aligned with trench along a vertical direction perpendicular to the lengthwise direction for receiving the side edge of the electronic card, the latch mechanism includes a pair of horizontal portions connected with the inclined portions respectively, the horizontal portions are retained in the retention slots and sandwiched between the protrusions and the lower walls of the retention slots along the vertical direction, respectively, the trench is located between the pair of horizontal portions along a transverse direction perpendicular to the lengthwise direction.

5. The card edge connector as claimed in claim 4, wherein the lower walls each defines a retention hole recessed downwardly, the latch mechanism includes a pair of retaining portions bending and extending downwardly from the horizontal portions, and inserted in the retention holes respectively.

6. The card edge connector as claimed in claim 4, wherein the horizontal portions each includes an inner part retained the retention slot, and an outer part extending beyond the retention slot into the cavity from the inner part, the inclined portions each connects with the outer part to define a pivot therebetween, the inclined portions can be flexibly deformed and pivot around the pivots to urge the locking projection to move into the trench or alternatively into the cavity.

7. The card edge connector as claimed in claim 4, wherein the retention slots each defines a first wall, a second wall opposite to the first wall along the transverse direction, and an end wall connected therebetween, the trench is located among the reinforcement wall and the first walls, the reinforcement wall is connected between the first walls, the lower wall is connected among the end wall, the first wall, and the second wall.

8. The card edge connector as claimed in claim 1, further comprising an ejector rotatably mounted upon another end of the housing and opposite to the latch mechanism along the lengthwise direction, the ejector defines a locking head and an operating portion both of which are located above the corresponding end of the housing under condition that the locking head locking with another notch opposite to the first notch along the lengthwise direction while the operating portion extends away from housing, and a lower ejecting portion under the center slot.

9. A card edge connector comprising:

an elongated housing extending along a lengthwise direction, and defining a center slot extending in the housing along the lengthwise direction, and a pair of tower portions located at two opposite ends thereof;

a plurality of contacts disposed in the housing and located at two sides of the center slot;

a push-out ejector rotatably mounted in one of the tower portions and defining a locking head extending into the central slot; and a resilient latch mechanism fixed to the other one of the tower portions and defining a pair of locating portions retained in the housing, and a pair of inclined portions extending slantly downwardly toward each other to intersect with each other to defines a lower locking projection extending into the center slot, the inclined portions each connecting with the locating portion to define a pivot therebetween, the inclined portions being flexibly deformed and pivot around the pivots to urge the locking projection to move along the lengthwise direction during one side edge resisting the inclined portions; wherein the locking head of the ejector and the locking protrusion are located two different high for respectively locking into corresponding notches respectively located on two sides of an electronic card at the two different high, wherein the locking portion presents as V-shaped viewed from a top side, the locating portions extend toward the central slot from the inclined portions along the lengthwise direction respectively, and are located at two opposite sides of the central slot, wherein the latch mechanism is a bent rod, and made of metallic material, the tower portion includes a pair of retention wall each defining a retention slot, and a cavity in communication with retention slot and the central slot, the housing includes a cover having a top plate covered the tower portion, and a pair of protrusions protruding downwardly into the retention slots from the to plate, the locating portions are sandwiched between the protrusions and lower walls of the retention slot along an upper-to-lower direction respectively.

10. The card edge connector as claimed in claim 9, wherein the locating portions each has an inner part received in the retention slot, and an outer part extending beyond the retention slot into the cavity from the inner part, the latch mechanism includes a pair of retaining portions extending downwardly from two ends of the inner part and inserted into retention holes of the lower wall.

11. A card edge connector assembly comprising:

an elongated housing defining an elongated slot along a lengthwise direction;

a pair of towers located at two opposite ends of the housing in said lengthwise direction;

a plurality of contacts respectively located in the housing and by two sides of said elongated slot;

an ejector located at one tower and pivotal with regard to said tower, said ejector including an lower kicker and an upper locker which is located above the corresponding tower; and a latching mechanism located at the other tower and resilient relative to the corresponding tower, and including a locking projection protectively located below a top end of the corresponding tower, wherein a cap is mounted upon the top end of said corresponding tower for hiding said latching mechanism, wherein said upper locker of the ejector is higher than the locking projection in a vertical direction, further including a mating card inserted in the slot wherein said mating card has upper and lower notches on each side edge under condition that the upper notch on one side edge receives the locker while the lower notch on the other side edge receives the locking projection.

* * * * *